US006759637B2

(12) United States Patent
Kim

(10) Patent No.: US 6,759,637 B2
(45) Date of Patent: Jul. 6, 2004

(54) DEVICE AND METHOD FOR INPUTTING RECIPE DATA IN MICROWAVE OVEN

(75) Inventor: Tae-Sung Kim, Changwon Gyeongnam (KR)

(73) Assignee: LG Electronics Inc., Seoul (KR)

( * ) Notice: Subject to any disclaimer, the term of this patent is extended or adjusted under 35 U.S.C. 154(b) by 77 days.

(21) Appl. No.: 10/166,663

(22) Filed: Jun. 12, 2002

(65) Prior Publication Data

US 2003/0000947 A1 Jan. 2, 2003

(30) Foreign Application Priority Data

Jul. 2, 2001 (KR) ..... 10-2001-0039347

(51) Int. Cl.[7] ..... H05B 6/68
(52) U.S. Cl. ..... 219/702; 219/720
(58) Field of Search ..... 219/702, 720, 219/506, 714, 715, 719, 704, 708, 494, 497; 99/325

(56) References Cited

U.S. PATENT DOCUMENTS 5,321,232 A * 6/1994 Ogle ..... 219/506
5,352,874 A * 10/1994 Gong ..... 219/704
6,180,934 B1 * 1/2001 Ishizaki et al. ..... 219/720
6,486,453 B1 * 11/2002 Bales et al. ..... 219/702

* cited by examiner

*Primary Examiner*—Quang T. Van
(74) *Attorney, Agent, or Firm*—Fleshner & Kim, LLP

(57) ABSTRACT

A device and method for inputting recipe data in a microwave oven is provided by which when a user adds a new recipe menu to the microwave oven, the user can input a recipe name suitable for the added recipe menu. The user inputs data for a new recipe in order to perform a new cooking in the microwave oven, and the data, including a cooking period of time and cooking power set by the user, are stored in a recipe storage unit of the device. Further, when the user inputs a new recipe name for the recipe data by inputting characters or alphabets into a display screen, the recipe name is stored in a recipe name storage unit of the device so that the user can conveniently perform the same cooking operation again in the future.

7 Claims, 3 Drawing Sheets

DEVICE AND METHOD FOR INPUTTING RECIPE DATA IN MICROWAVE OVEN

BACKGROUND OF THE INVENTION

1. Field of the Invention

The present invention relates to a microwave oven, and more particularly, to a device and method for inputting recipe data in a microwave oven by which the recipe data such as names and contents of recipes for the microwave oven desired by a user can be stored so that cooking can be simply made upon repetitive cooking of dishes corresponding to the recipe data.

2. Description of the Prior Art

Generally, a microwave oven is a cooking machine for cooking foodstuffs by causing microwaves outputted from a magnetron to penetrate into the foodstuffs. When a user utilizes such a microwave oven, the user selects a dish menu and a cooking period of time by manipulating keys provided in a key input section of the microwave oven and presses a cooking start key. Then, the magnetron is driven according to the dish menu inputted by the user so as to perform a cooking process by irradiating the high-frequency microwaves into a cooking chamber.

Further, when the user selects a grill function or convection function, a heater of the microwave oven is driven. The heat generated from the heater is forcedly circulated by an interior cooling fan and thus the foodstuffs can be cooked.

During such a cooking period of time in which the foodstuffs are cooked, a message of elapse of the cooking period of time or a remaining cooking period of time is displayed on a recipe screen of a display unit of the microwave oven. When the cooking period of time according to the selected dish menu is lapsed, the message of the cooking completion is displayed on the screen of the display unit.

Such a conventional microwave oven will be described in detail with reference to the accompanying drawings.

FIG. 1 is a view showing a configuration for controlling a display screen of the conventional microwave oven.

First, the constitution of the conventional microwave oven will be described. The conventional microwave oven comprises a microcomputer 1 in which programs for operating the microwave oven are installed, an oscillation circuit 6 for supplying the microcomputer 1 with reference clock pulses so that the microcomputer 1 can execute the programs, and a power circuit 2 for supplying electric power to the microcomputer 1.

The conventional microwave oven further comprises a key input circuit 3 for allowing the user to input functions of the microwave oven the user wants, a display unit 4 for notifying the user to confirm contents inputted from the key input circuit 3 and an operation state of the microwave oven, and a relay control unit 5 for allowing the microcomputer 1 to operate the microwave oven in response to the contents inputted from the key input circuit 3.

A method for controlling the display screen of the conventional microwave oven constructed as such will be described below.

FIG. 2 shows the display screen for allowing the user to set a "user's recipe" of the conventional microwave oven.

The user selects the "user's recipe," which is displayed on a display screen as shown in a block 2-*a* of FIG. 2, through the key input circuit 3 to newly perform an arbitrary dish menu rather than dish menus that have been beforehand set in the microwave oven. A signal generated from a key selected by the user is inputted into the microcomputer 1. The microcomputer 1 controls a control signal, which corresponds to the function selected by the user, to be displayed onto the display unit 4. The display unit 4 displays a screen for setting a cooking period of time and cooking power, as shown in a block 2-*b* of FIG. 2, in response to the control signal of the microcomputer 1, so that the user can set the cooking period of time and the cooking power for the "user's recipe" selected by the user.

At this time, the latest data set by the user are displayed on the "user's recipe" display screen. The data displayed on the display screen can be set again by changing the cooking period of time and the cooking power through selection of a change key by the user.

Therefore, when the user selects the change key, a screen for allowing the user to newly input data is displayed. Accordingly, while viewing the display screen, the user can arbitrarily set the cooking period of time and the cooking power through the key input circuit 3 on a display screen shown in a block 2-*c* of FIG. 2.

After the cooking period of time is set in such a way, a start key provided in the key input circuit 3 is pressed on a display screen shown in a block 2-*d* of FIG. 2. When the user presses the start key, the microcomputer 1 receives a signal corresponding to the start key from the key input circuit 3, controls the signal, and outputs control signals to the relay control unit 5 and the display unit 4. Thus, the microwave oven is driven for the newly set cooking period of time in accordance with the newly set recipe data. Then, the display unit 4 of the microwave oven informs the user that the cooking in the microwave oven is in progress by displaying a screen shown in a block 2-*e* of FIG. 2 on the display unit.

However, there are several problems in the method for inputting new recipe data in the conventional microwave oven.

First, a new and arbitrary dish menu which the user has already set in the microwave oven was not stored therein. Therefore, there is an inconvenience in that the user should input the cooking period of time again whenever the same menu as beforehand set by the user is cooked. As a result, it is difficult to provide the user with the convenience of use of the microwave oven.

Furthermore, if the user does not remember the new and arbitrary dish menu that has been beforehand inputted by the user, there is a problem in that the user cannot correctly perform the recipe by using the microwave oven.

SUMMARY OF THE INVENTION

Therefore, an object of the present invention is to provide a device and method for inputting recipe data in a microwave oven, wherein a user sets desired recipe data for performing cooking in the microwave oven and the recipe data set by the user are stored in the microwave oven so that the user can easily select the desired recipe in the future.

A device for inputting recipe data in a microwave oven for achieving the above object comprises a display unit for providing a recipe setting screen and a recipe name setting screen so that a user can set data on a new recipe; a recipe storage unit in which a new recipe setting screen that is set by the user in accordance with the recipe setting screen of the display unit is stored; a recipe name storage unit in which a new recipe name setting screen that is set by the user in accordance with the recipe name setting screen of the display unit is stored; and a microcomputer for controlling the display unit and the data stored in the storage units so that a new recipe name and the new recipe are displayed on the display unit upon request of the user.

Further, a method for inputting recipe data in a microwave oven according to the present invention comprises a selection step of selecting, by a user, a user's recipe menu for adding data on a new recipe; a recognition step of recognizing, by the microwave oven, a selection signal corresponding to the selection of the user's recipe menu; a display step of providing a recipe setting screen in response to the selection signal so that the user can set and check the new recipe; a recipe and recipe name data setting step of setting, by the user, data on the new recipe and a recipe name thereof in accordance with the setting screen provided in the display step; and a data storage step of storing values that are set in the setting step.

BRIEF DESCRIPTION OF THE DRAWINGS

The above and other objects and features of the present invention will become apparent from the following description of a preferred embodiment given in conjunction with the accompanying drawings, in which.

DETAILED DESCRIPTION OF THE PREFERRED EMBODIMENTS

Hereinafter, a device and method for inputting recipe data in a microwave oven according to the present invention will be described in detail with reference to the accompanying drawings.

Figure 1:
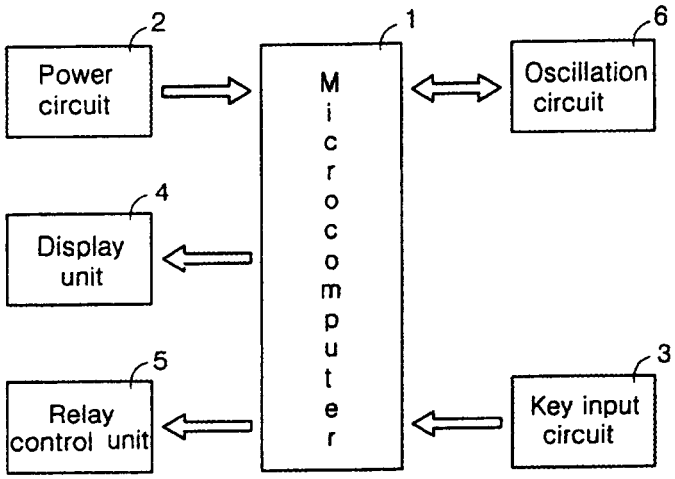
FIG. 1 is a view showing a configuration for controlling a display screen of a conventional microwave oven.
Figure 2:
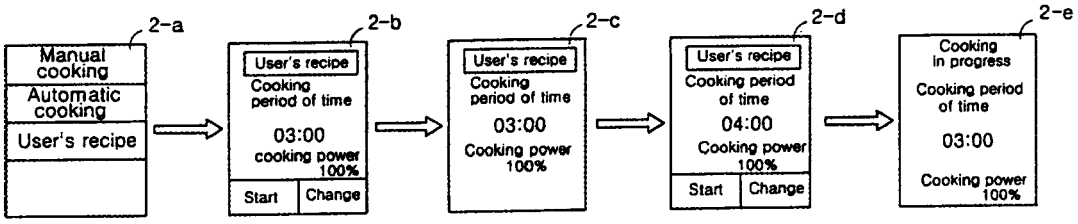
FIG. 2 shows a display screen for allowing a user to set a "user's recipe" of the conventional microwave oven.
Figure 3:
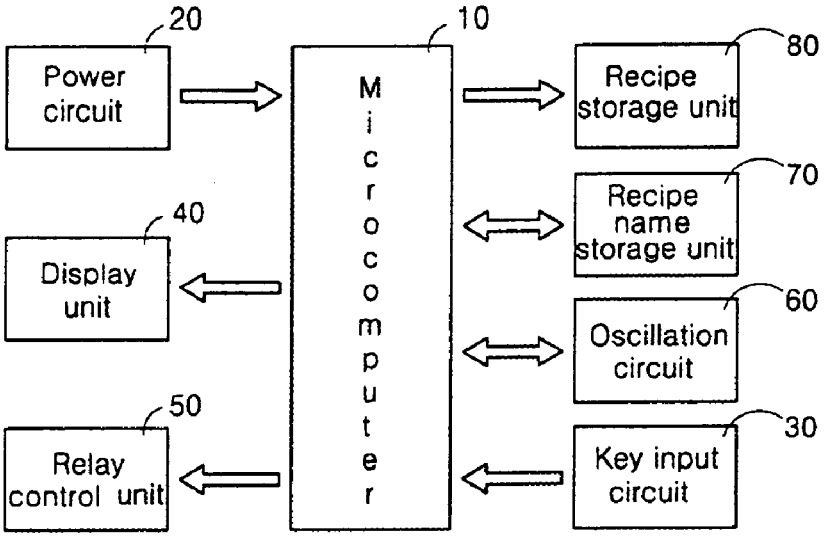
FIG. 3 is a view showing a configuration for controlling a display screen of a microwave oven according to the present invention.

FIG. 3 is a view showing a configuration for controlling a display screen of a microwave oven according to the present invention.

First, the microwave oven of the present invention comprises a microcomputer 10 in which programs for operating the microwave oven are installed and which outputs various kinds of control signals required for operations of the microwave oven, an oscillation circuit 60 for supplying the microcomputer 10 with reference clock pulses so that the microcomputer 10 can execute the programs, and a power circuit 20 for supplying electric power to the microcomputer 10.

The microwave oven further comprises a key input circuit 30 for allowing a user to input functions of the microwave oven the user wants, a display unit 40 for notifying the user to confirm contents inputted from the key input circuit 30 and an operation state of the microwave oven, and a relay control unit 50 for allowing the microcomputer 10 to operate the microwave oven in response to the contents inputted from the key input circuit 30.

The microwave oven still further comprises a recipe storage unit 80 in which a recipe for the microwave oven inputted by the user is stored, and a recipe name storage unit 70 in which a recipe name corresponding to the user's recipe inputted by the user is stored.

A method for inputting recipe data in the microwave oven according to the present invention constructed as such will be described in detail with respect to a preferred embodiment thereof.

Figure 4:
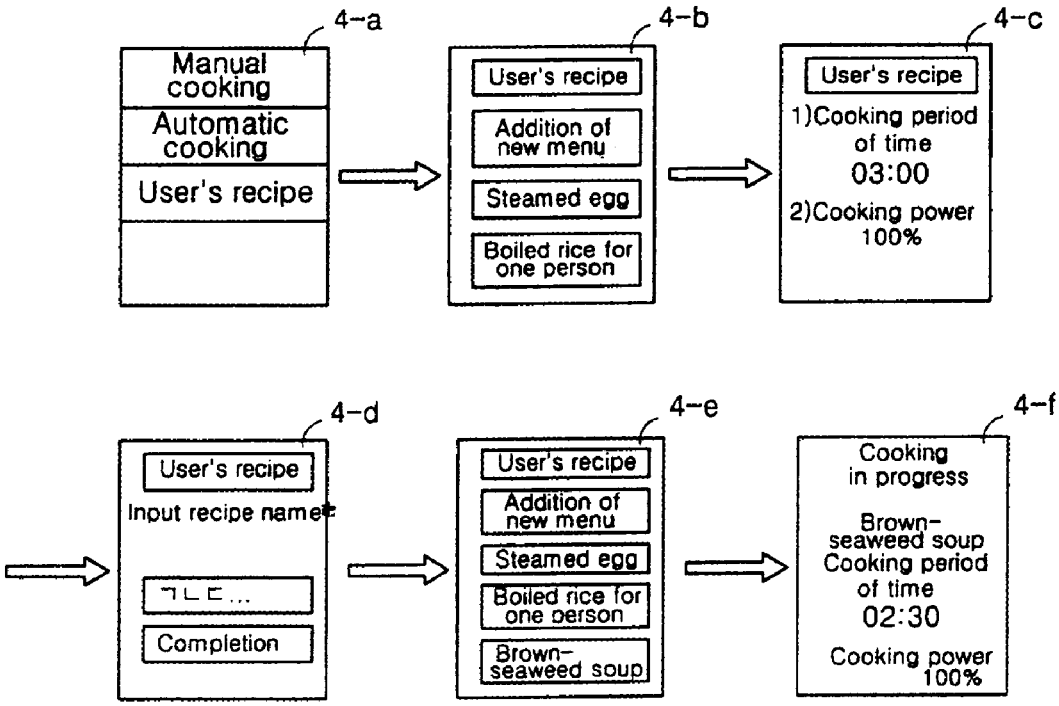
FIG. 4 shows a display screen for allowing a user to set a "user's recipe" of the microwave oven according to the present invention.
Figure 5:
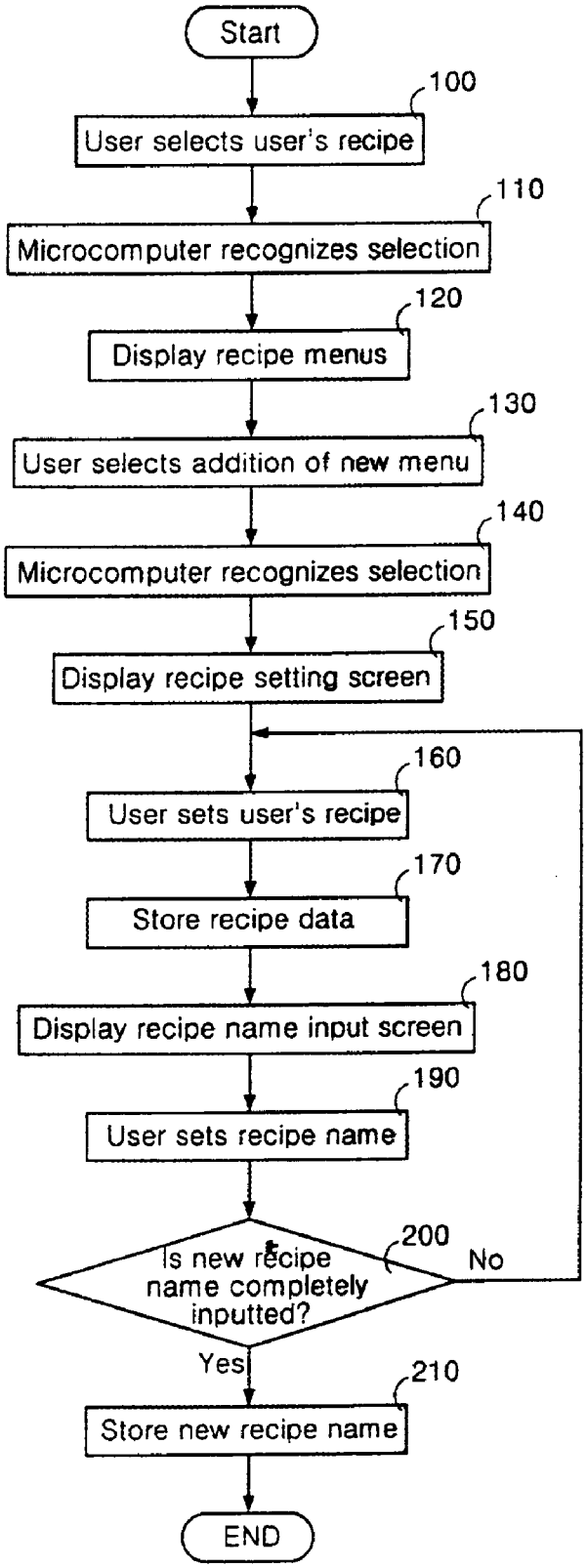
FIG. 5 is a flowchart illustrating a method for inputting recipe data in the microwave oven according to the present invention.

FIG. 4 shows a display screen for allowing a user to set new recipe data in the microwave oven according to the present invention, and FIG. 5 is a flowchart illustrating a method for inputting or setting the recipe data.

When the user wants to perform cooking in the microwave oven, the user first selects a desired recipe in an initial screen of the microwave oven through the key input circuit 30 (step 100). Here, the recipes of the microwave oven are categorized into a "manual cooking," an "automatic cooking" and a "user's recipe." The phrases of "manual cooking," "automatic cooking," and "user's recipe" are displayed on the screen of the display unit of the microwave oven as shown in a block 4-*a* of FIG. 4. In the screen displayed in such a way, the user inputs the "user's recipe" through the key input circuit 30 of the microwave oven 30 in order to set a new recipe menu. Accordingly, a signal corresponding to the "user's recipe" selected by the user is inputted into the microcomputer 10 of the microwave oven, and the microcomputer 10 then controls a control signal in response to the "user's recipe" signal to be displayed onto the display unit 40 (step 110).

In step 110, the display unit 40 displays recipe menus related to the "user's recipe" on the next screen in response to the control signal of the microcomputer 10 (step 120). That is, as shown in a block 4-*b* of FIG. 4, the recipe menus of the "user's recipe" include menus that have been previously set, and an "addition of new menu" menu through which the user can set a new menu.

Then, if the user wants to newly set an arbitrary menu, the user can select an "addition of new menu" key (step 130). In step 130, a signal corresponding to the key selected by the user is inputted into the microcomputer 10. Then, the microcomputer 10 controls a control signal in response to the signal inputted by the user to be displayed onto the display unit 40 of the microwave oven (step 140).

As a result, the display unit 40 provides the user with a user's setting screen as shown in a block 4-*c* of FIG. 4 in response to the control signal of the microcomputer 10, so that the user can set data on a new recipe menu (step 150).

The user's setting screen (shown in the block 4-*c* of FIG. 4) is comprised of a screen for allowing the user to set a cooking period of time and cooking power. The user confirms the user's setting screen and then sets the cooking period of time and the cooking power for the recipe menu to be newly added by selecting numerical keys of the key input key 30 (step 160).

The data on the cooking period of time and the cooking power set by the user in step 160 are inputted into the microcomputer 10 which in turn transmits the data to the recipe storage unit 80. Then, the data on the cooking period of time and the cooking power for the new recipe menu set by the user are stored in the recipe storage unit 80 (step 170).

When the data on the cooking period of time and the cooking power are stored in the recipe storage unit 80 in step 170, the microcomputer 10 outputs a control signal to the display unit 40 so that the user can newly set a recipe name for the recipe menu. Accordingly, the display unit 40 provides the user with a recipe name input screen as shown in a block 4-*d* of FIG. 4 by which the user can input a new recipe name for the recipe menu (step 180).

The user checks the recipe name input screen and then sets the recipe name for the recipe menu by combining consonants and vowels, or alphabets provided in the key input circuit 30 (step 190). When the user completes the setting of the recipe name for the recipe menu, the user selects a setting completion key of the key input circuit 30 to complete the setting of the new recipe name.

When the user presses the setting completion key, a signal corresponding to the setting completion key is inputted into the microcomputer 10. The microcomputer 10 determines whether the user completes the setting of the new recipe menu and selects the setting completion key of the key input circuit 30 (step 200).

In step 200, if it is determined that the user has selected the setting completion key, data on the recipe name for the recipe menu set by the user are outputted to the recipe name storage unit 70. Then, the data on the recipe name for the recipe menu received from the microcomputer 10 are stored in the recipe name storage unit 70 (step 210).

The recipe name additionally stored in such a control operation ("brown-seaweed soup" in this embodiment of the present invention) is simultaneously displayed together with the other recipe menus on the display unit 40, as shown in a block 4-*e* of FIG. 4. If the user selects the newly added recipe menu through the key input circuit 30 in such a displayed state, the microcomputer 10 recognizes a signal corresponding to the selection. Then, the microcomputer 10 controls the microwave oven so that the data on the newly added recipe menu are displayed on the display unit 40 as shown in a block 4-*f* of FIG. 4, and at the same time, the cooking starts to be performed.

As described above, the basic technical sprit of the present invention is that if the user adds a new recipe menu when performing the cooking by using the microwave oven, the new recipe menu inputted by the user is stored and then the user can repeatedly utilize the added recipe menu in a convenient manner.

According to the device for inputting the recipe data in the microwave oven of the present invention, when the user adds a new recipe menu, the user can input a desired recipe name suitable for the added recipe and thus can easily select a desired recipe menu among inputted recipe menus of the user's recipe.

Further, even though the user cannot remember information on the newly added recipe, the user can perform the desired recipe simply by selecting the relevant recipe name. Thus, there is an advantage in that the user can more conveniently and efficiently perform the cooking using the microwave oven.

Moreover, once the user sets and inputs a desired recipe, the user can perform the cooking suitable for himself/herself by selecting the inputted user's recipe name at any time. Thus, there is another advantage in that the user is fully satisfied with the microwave oven of which convenience of use is improved.

The present invention is not limited to the embodiment described above, but defined by the claims. It can be understood by the skilled in the art that various changes and modifications can be made thereto within the scope of the invention defined by the claims.

What is claimed is:

1. A method for inputting recipe data in a microwave oven, comprising:

displaying a user's recipe menu including an option for adding a new recipe;

recognizing a selection signal corresponding to selection of the option on the user's recipe menu for adding a new recipe;

a displaying a recipe screen in response to the selection signal so that a user can input the new recipe; and receiving input of data for the new recipe and the new recipe name by a user.

2. The method as claimed in claim 1, further comprising:

storing the data for the new recipe and the new recipe name for later retrieval by a user.

3. The method as claimed in claim 2, wherein receiving input of data for the new recipe and the new recipe name by a user and storing the data for the new recipe and the new recipe name for later retrieval by a user comprises:

receiving input of data for the new recipe; and then storing the input data.

4. The method as claimed in claim 3, wherein receiving input of data for the new recipe and the new recipe name by a user and storing the data for the new recipe and the new recipe name for later retrieval by a user further comprises:

receiving input of the new recipe name; and then storing the new recipe name.

5. The method as claimed in claim 4, wherein receiving input of data for the new recipe and the new recipe name by a user and storing the data for the new recipe and the new recipe name for later retrieval by a user further comprises:

checking to determine if the new recipe name has been completely input.

6. The method as claimed in claim 1, further comprising:

displaying a list of cooking options, including an option for displaying a user's recipe menu.

7. The method as claimed in 1, wherein the user's recipe menu includes a list of previously input recipes.

* * * * *